US006389251B2

(12) United States Patent
Kusunose

(10) Patent No.: US 6,389,251 B2
(45) Date of Patent: May 14, 2002

(54) ELECTROPHOTOGRAPHIC IMAGE FORMING APPARATUS INCLUDING DISCHARGING DEVICE

(75) Inventor: Noboru Kusunose, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/765,620

(22) Filed: Jan. 22, 2001

(30) Foreign Application Priority Data

Jan. 20, 2000 (JP) ..... 2000-011207

(51) Int. Cl.[7] ..... G03G 21/16
(52) U.S. Cl. ..... 399/111; 399/115
(58) Field of Search ..... 399/107, 111, 399/115, 167, 168, 176, 316, 186

(56) References Cited

U.S. PATENT DOCUMENTS 5,828,935 A 10/1998 Tatsumi et al. ..... 399/260
6,064,841 A * 5/2000 Matsuzaki et al. ..... 399/176 X
6,118,951 A 9/2000 Kato et al. ..... 399/27
6,278,859 B1 * 8/2001 Nagano ..... 399/316

FOREIGN PATENT DOCUMENTS

JP 64000984 A 1/1989
JP 08087215 A 4/1996

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

An electrophotographic image forming apparatus includes a process cartridge and a discharging device. The process cartridge includes a photo-receptor and a charging device. A toner image is formed on the photo-receptor. The charging device is configured to uniformly charge a surface of the photo-receptor. The discharging device is provided outside of the process cartridge and configured to emit light to discharge the surface of the photo-receptor. The process cartridge also includes a light incidence opening to pass the light emitted from the discharging device therethrough, and the light incidence opening is formed to regulate the passed light so as to irradiate an area of the surface of the photo-receptor.

13 Claims, 7 Drawing Sheets

ELECTROPHOTOGRAPHIC IMAGE FORMING APPARATUS INCLUDING DISCHARGING DEVICE

CROSS-REFERENCE TO RELATED APPLICATIONS

The present invention claims priority and contains subject matter related to Japanese Patent Application No. 2000-011207, filed in the Japanese Patent Office on Jan. 20, 2000, the entire contents of which is incorporated by reference herein.

BACKGROUND OF THE INVENTION

1. Field of the Invention

The present invention generally relates to either an image forming apparatus, such as a copying machine, a printer, a facsimile, etc., or a multi-functional image forming apparatus and more particularly, to an electrophotographic image forming apparatus, wherein a toner image is formed on a photo-receptor so that by repeating an image forming process, including charging, image writing, developing, transferring, cleaning, discharging, etc., the toner image is transferred to a recording medium directly or via an intermediate transfer member.

2. Discussion of the Background

In an image forming apparatus employing an electrophotography process, such as a copying machine, a printer, a facsimile, or similar, an increasing number of the image forming apparatuses are made compact by employing a process cartridge, wherein a photo-receptor, a charging device, a developing device, etc. are integrally accommodated in a case.

With the demand for reducing the size of the image forming apparatus, the process cartridge has been made more compact. Consequently, a discharging device is likely to be arranged outside of the process cartridge due to a lack of space in the process cartridge.

As illustrated in FIG. 6, when a discharging device 1 is arranged inside of a process cartridge 2, light, indicated by a reference character L1 and emitted from the discharging device 1, passes through aback side of a charging device 3. Further, the light L1 is reflected by an inner surface of a cartridge case 4 of the process cartridge 2 and then, a surface of a photo-receptor 5 is irradiated with the light L1.

The above-described light L1 causes a problem because a charged potential of the surface of the photo-receptor 5, which is uniformly charged by the charging device 3, is changed due to the irradiation of the light L1. The above-mentioned problem is solved by arranging the discharging device 1 outside of the process cartridge 2.

However, as illustrated in FIG. 7, when the discharging device 1 is arranged outside of the process cartridge 2, because the discharging device 1 is apart from the photo-receptor 5, the amount of light, emitted from the discharging device 1 to the photo-receptor 5, needs to be increased.

When the amount of light emitted from the discharging device 1 increases, the light from the discharging device 1 is likely to scatter. As a result, light, indicated by a reference character L2, passes through a relatively large cutaway portion of the cartridge case 4 and then, the surface of the photo-receptor 5, which is located immediately before a position B, where the charging device 3 charges the surface of the photo-receptor 5 (hereinafter referred to as a charging position B), is directly irradiated with the light L2. Thereafter, when the irradiated surface of the photo-receptor 5 is charged by the charging device 3, the charged potential of the surface of the photo-receptor 5 becomes low.

Further, when the light, emitted from the discharging device 1, scatters, the surface of the photo-receptor 5, which is located immediately before the charging position B, is irradiated with a light indicated by a reference character L3, emitted from the discharging device 1, and reflected by a cleaning blade 7 of a cleaning device 6. In such a case, when the irradiated surface of the photo-receptor 5 is charged by the charging device 3, the charged potential of the surface of the photo-receptor 5 also becomes low.

Furthermore, when the light, emitted from the discharging device 1, scatters, the surface of the photo-receptor 5, which is located immediately before the charging position B, is irradiated with a light indicated by a reference character L4, emitted from the discharging device 1, first reflected by the surface of the photo-receptor 5 and then, reflected by the cleaning blade 7 of the cleaning device 6. Similarly, as in the above-described two cases, when the irradiated surface of the photo-receptor 5 is charged by the charging device 3, the charged potential of the surface of the photo-receptor 5 becomes low.

The above-described lowering of the charged potential of the surface of the photoreceptor results in deterioration of image quality.

SUMMARY OF THE INVENTION

The present invention has been made in view of the above-discussed and other problems, and an object of the present invention is to address these and other problems.

Accordingly, another object of the present invention is to provide a novel electrophotographic image forming apparatus, wherein lowering of a charged potential of a surface of a photo-receptor, which is caused by irradiating the surface of the photo-receptor, located immediately before a charging position, with a light emitted from a discharging device, can be prevented.

These and other objects are achieved, according to the present invention, by providing a novel electrophotographic image forming apparatus that includes: a process cartridge, including at least a photo-receptor, on which a toner image is formed, and a charging device, configured to uniformly charge a surface of the photo-receptor; and a discharging device, provided outside of the process cartridge and configured to emit light to discharge the surface of the photo-receptor. The process cartridge includes a light incidence opening to pass the light emitted from the discharging device therethrough. The light incidence opening is formed to regulate the passed light so as to irradiate an area of the surface of the photo-receptor.

The irradiated area of the surface of the photo-receptor may be outside of an area of the surface of the photo-receptor, within 5 mm from a position where the charging device charges the surface of the photo-receptor, at an upstream side of the position.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
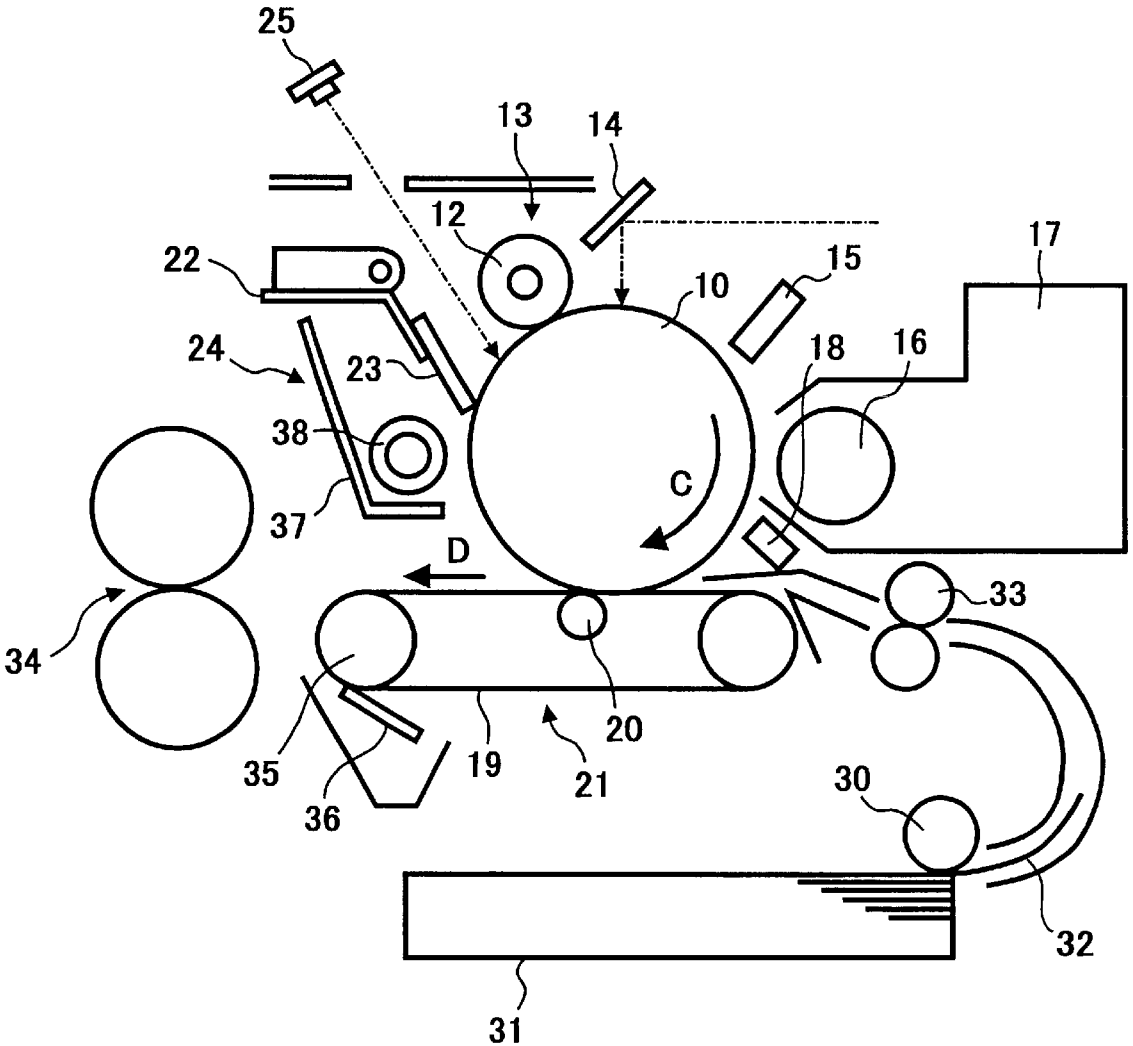
FIG. 1 is a schematic view illustrating an overall structure of an electrophotographic image forming apparatus of the present invention.

Preferred embodiments of the present invention are described in detail, in reference to the drawings, wherein like reference numerals designate identical or corresponding parts throughout the several views.

FIG. 1 is a schematic view illustrating an overall structure of an electrophotographic image forming apparatus of the present invention. The reference numeral 10 indicates a drum-shaped photo-receptor with a 30 mm diameter, including photoconductive layers, such as optical photoconductor or OPC layers. The photo-receptor 10 is rotated in a direction indicated by arrow C.

At an upper side of the photo-receptor 10, a contact-type charging device 13 is arranged and includes a charging roller 12 with a 20 mm diameter. A charging device is broadly divided into two types, namely, a "corona charging type" and a "contact charging type." The charging device of the corona charging type applies electric charge to a surface of a photo-receptor by a corona charger. The corona charger does not contact the photo-receptor.

In the charging device of the contact charging type, a charging roller contacts the surface of the photo-receptor, and bias voltage is applied to the charging roller to charge the surface of the photo-receptor. The contact-type charging device is often employed due to advantages in low occurrence rate of ozone and low energy.

Also arranged around the photo-receptor 10, in the following order, in the rotating direction of the photo-receptor 10, are: a laser writing device, the entirety of which is not shown, except for a mirror 14; an eraser 15; a developing device 17, including a developing sleeve 16; a pre-transfer light or PTL emitting device 18; a transferring/conveying device 21, including a transfer belt 19 and a bias roller 20; a cleaning device 24, in which a cleaning blade holder 22 holds a cleaning blade 23; and a discharging device 25.

The surface of the photo-receptor 10 is uniformly charged by application of a high voltage via the charging roller 12 of the charging device 13, while the photo-receptor 10 is rotating. Subsequently, the laser writing device emits a laser beam to the surface of the photo-receptor 10 by reflecting the laser beam off of the mirror 14. Thereby, the laser beam, corresponding to image information, forms an electrostatic latent image on the surface of the photo-receptor 10.

The eraser 15 erases the electrostatic latent image formed on end portions of the surface of the photo-receptor 10 to avoid the occurrence of a black line on a transfer sheet.

Subsequently, while the photo-receptor 10 is rotating, the electrostatic latent image, formed on the photo-receptor 10, is developed with toner supplied by the developing sleeve 16 of the developing device 17. The electrostatic latent image becomes a toner image on the surface of the photo-receptor 10. Thereafter, in order to increase transfer efficiency, the PTL emitting device 18 emits light to discharge the surface of the photo-receptor 10.

While forming a toner image on the photo-receptor 10, a sheet feeding roller 30 is rotated, and thereby a transfer sheet (i.e., a recording medium) 32 is fed from a sheet feeding tray 31 and kept on standby, with its leading edge abutting a nip part of a pair of registration rollers 33. Then, the registration rollers 33 rotate to feed the transfer sheet 32. The rotation of the registration roller 33 is in synchronization with the rotation of the photo-receptor 10. The rotation of the registration rollers 33 is timed so that a leading edge of the toner image formed on the photo-receptor 10 is aligned with a leading edge of the transfer sheet 32.

Thereby, the transfer sheet 32 is conveyed to a transfer position, formed at a nip between the photo-receptor 10 and the bias roller 20, by the transfer belt 19 of the transferring/conveying device 21. The toner image on the photo-receptor 10 is transferred to the transfer sheet 32 at the transfer position by applying a transfer bias (e.g., an electric charge of a polarity opposite to the polarity of the toner image) to the transfer belt 19 via the bias roller 20.

The transfer sheet 32, with the transferred toner image, is further conveyed in the direction indicated by arrow D to a fixing device 34 via the transfer belt 19. The transferred toner image is fixed to the transfer sheet 32 under the influence of heat and pressure in the fixing device 34. Then, the transfer sheet 32 is discharged onto a stacker (not shown).

The transfer belt 19 is coated with fluorine in order to reduce the friction coefficient. A leading edge of a cleaning blade 36, which is made of polyurethane rubber, abuts the surface of the transfer belt 19 at the side of a driving roller 35. The transfer belt 19 spans the driving roller 35. The cleaning blade 36 removes toner and paper dust from the surface of the transfer belt 19.

After the toner image on the photo-receptor 10 is transferred onto the transfer sheet 32, and while the photo-receptor 10 is rotating, the cleaning blade 23, which is made of polyurethane rubber and which is in contact with the surface of the photo-receptor 10, removes residual toner. The residual toner remains on the photo-receptor 10, without being transferred to the transfer sheet 32, from the surface of the photo-receptor 10. Thus, the surface of the photo-receptor 10 is cleaned by the cleaning device 24. The removed toner is collected in a container 37 and conveyed by spirals 38, and is returned to the developing device 17 by a conveying device (not shown).

The surface of the photo-receptor 10 is exposed to light to remove residual charge by the discharging device 25 and is then prepared for a next image forming operation. The discharging device 25 includes numerous light-emitting diodes arranged in the longitudinal direction of the photo-receptor 10.

Figure 2:
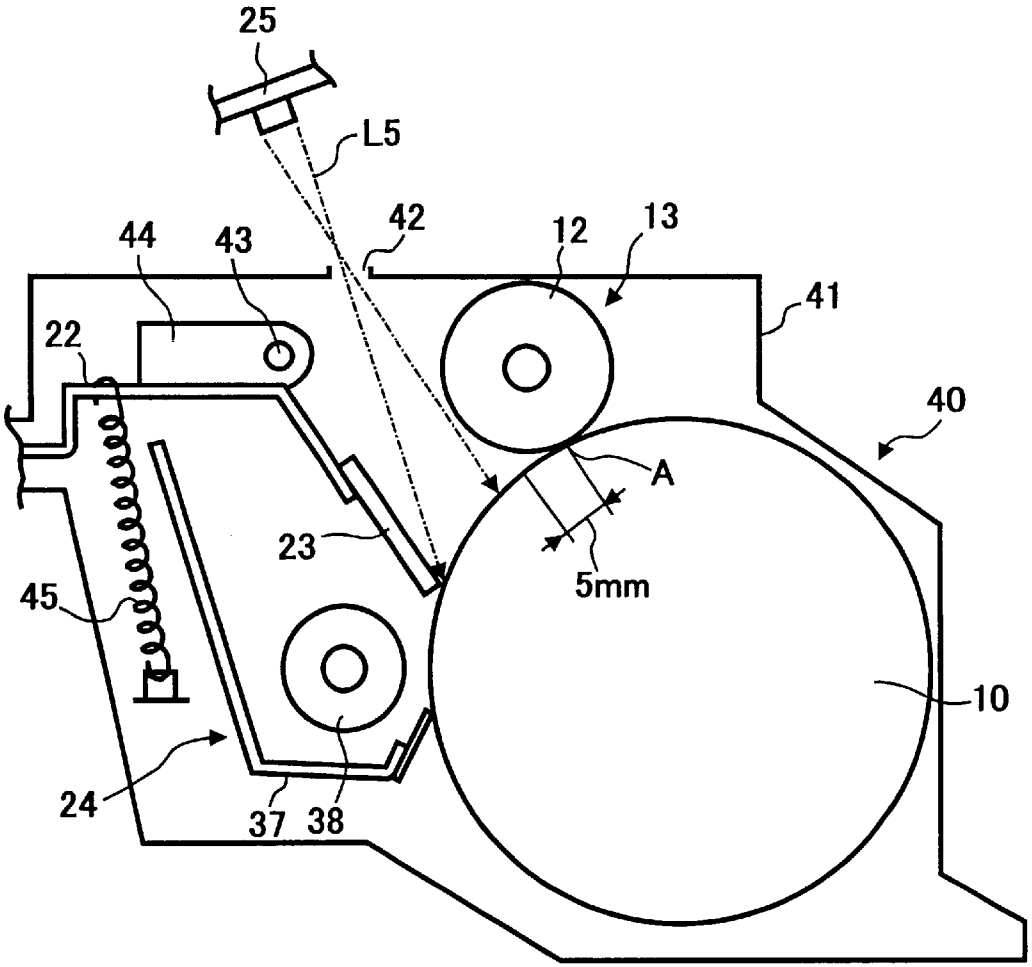
FIG. 2 is a schematic view of the electrophotographic image forming apparatus of the present invention, wherein a surface of a photo-receptor is directly irradiated with a light emitted from a discharging device.

The electrophotographic image forming apparatus of FIG. 1 includes a process cartridge 40 as illustrated in FIG. 2, for compact size and easy maintenance. A cartridge case 41 of the process cartridge 40 accommodates the photo-receptor 10, the charging device 13, and the cleaning device 24.

The discharging device 25 is provided in the electrophotographic image forming apparatus at the outside of the process cartridge 40 and is supported by a device (not shown). A light incidence opening 42 is formed in the cartridge case 41 of the process cartridge 40 to allow light, indicated by a reference character L5 and emitted from the discharging device 25, to pass therethrough. Further, the light incidence opening 42 is formed to regulate the amount of light L5 that passes therethrough, so as to irradiate an area of the surface of the photo-receptor 10, outside of an area of the surface of the photo-receptor 10 within 5 mm from a charging position A, where the charging device 13 charges the surface of the photo-receptor 10, at an upstream side of the charging position A.

Figure 3:
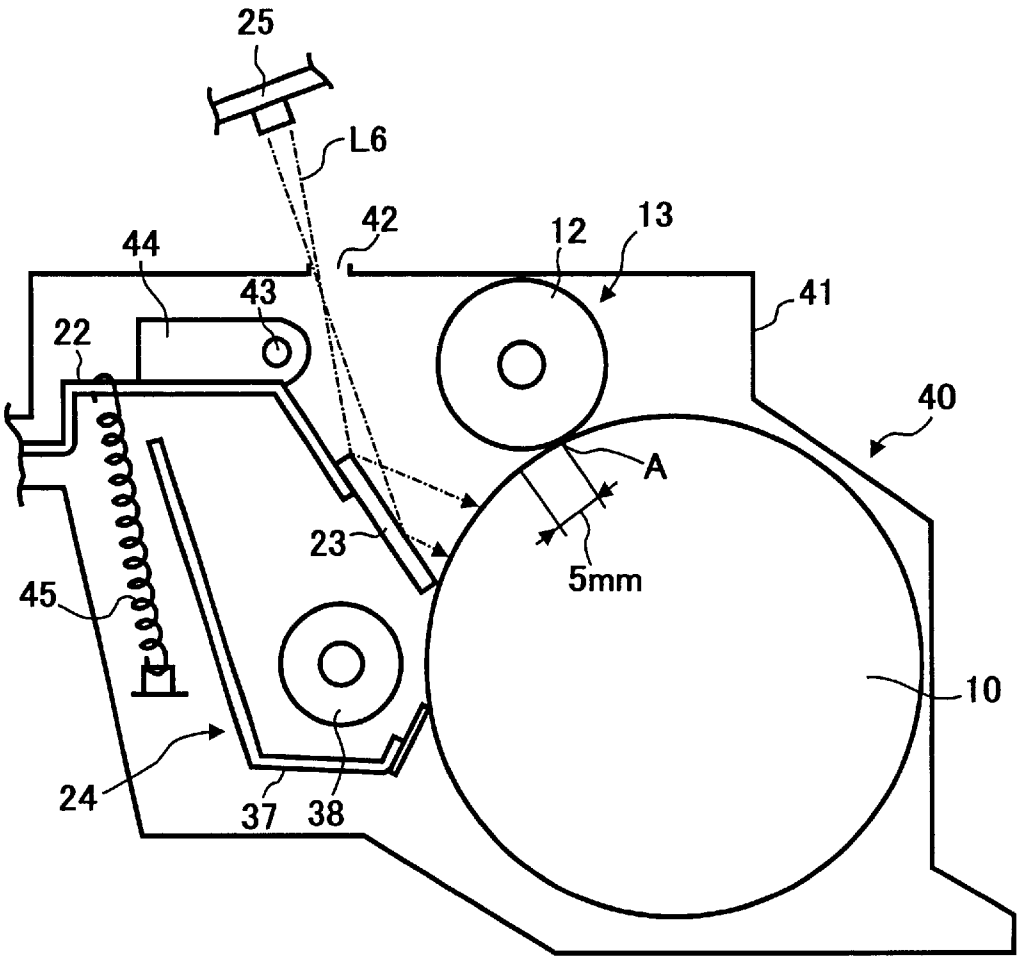
FIG. 3 is a schematic view of the electrophotographic image forming apparatus of the present invention, wherein the surface of the photo-receptor is irradiated with light emitted from the discharging device and reflected by a cleaning device.

In the electrophotographic image forming apparatus of FIG. 3, the photo-receptor 10, the discharging device 25, the light incidence opening 42, and the cleaning device 24 are arranged such that light, indicated by a reference character L6, emitted from the discharging device 25, and reflected by the cleaning blade 23 and the cleaning blade holder 22 of the cleaning device 24, does not lead to an area of the surface of the photo-receptor 10, within 5 mm from the charging position A, at an upstream side of the charging position A.

Figure 4:
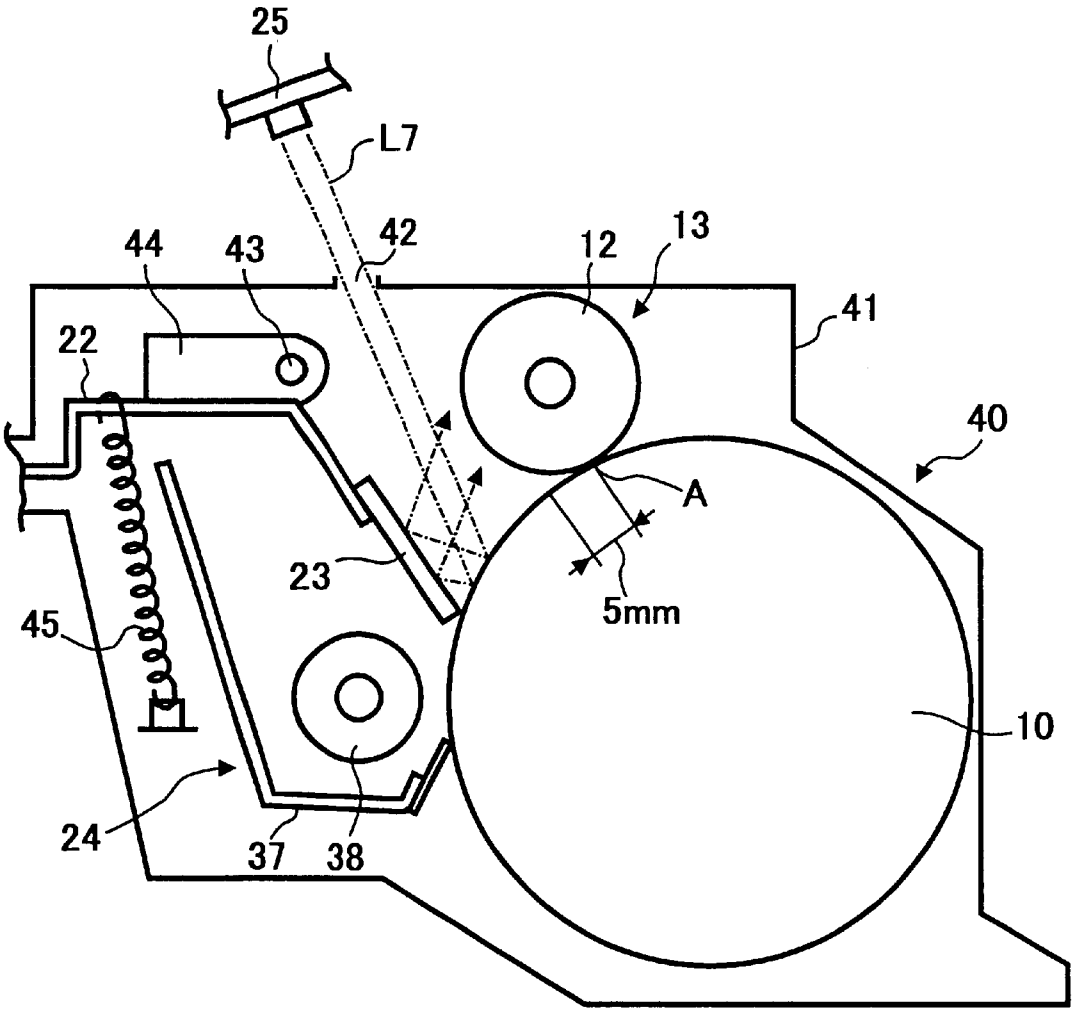
FIG. 4 is a schematic view of the electrophotographic image forming apparatus of the present invention, wherein the surface of the photo-receptor is irradiated with light emitted from the discharging device, first reflected by the surface of the photo-receptor and then, reflected by the cleaning device.

Further, in the electrophotographic image forming apparatus of FIG. 4, the photoreceptor 10, the discharging device 25, the light incidence opening 42, and the cleaning device 24 are arranged such that light, indicated by a reference character L7, from the discharging device 25, which is first reflected by the photo-receptor 10 and then reflected by the cleaning blade 23 and the cleaning blade holder 22 of the cleaning device 24, does not lead to an area of the surface of the photo-receptor 10, within 5 mm from the charging position A, at an upstream side of the charging position A.

Figure 5:
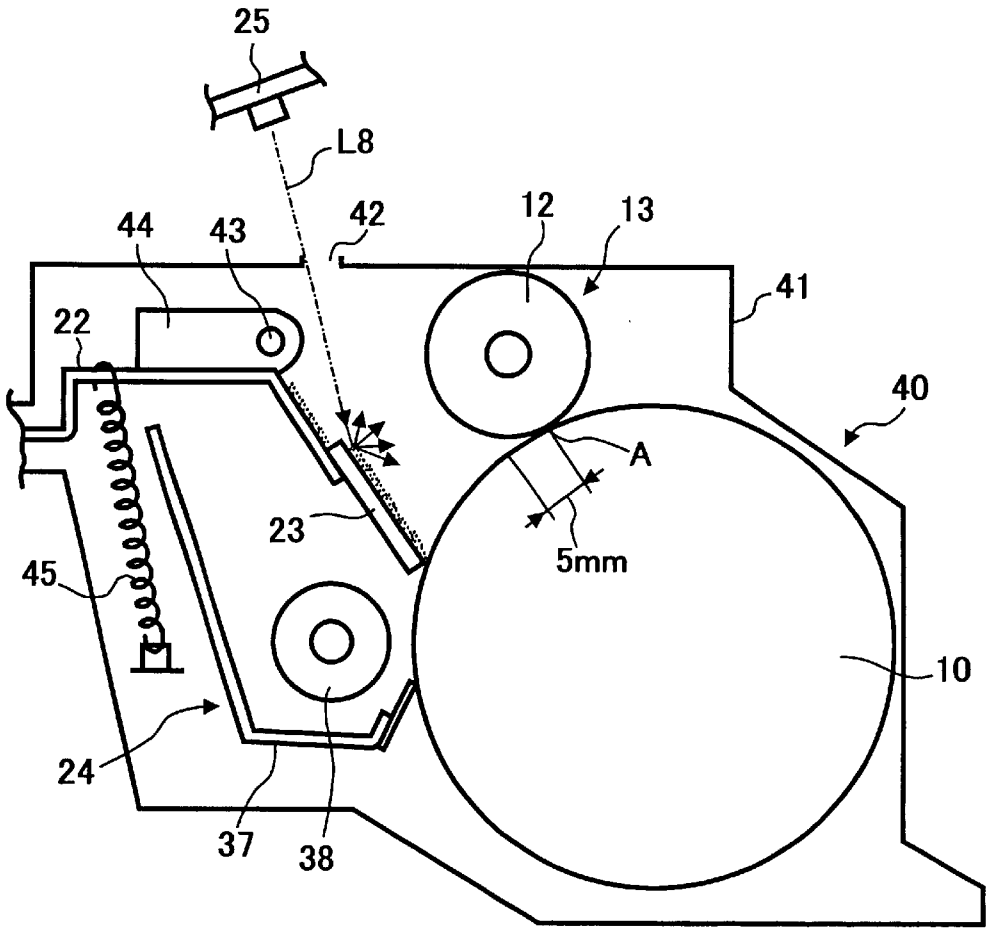
FIG. 5 is a schematic view of the electrophotographic image forming apparatus of the present invention, wherein a surface of each part of the cleaning device is subject to mat treatment.
Figure 6:
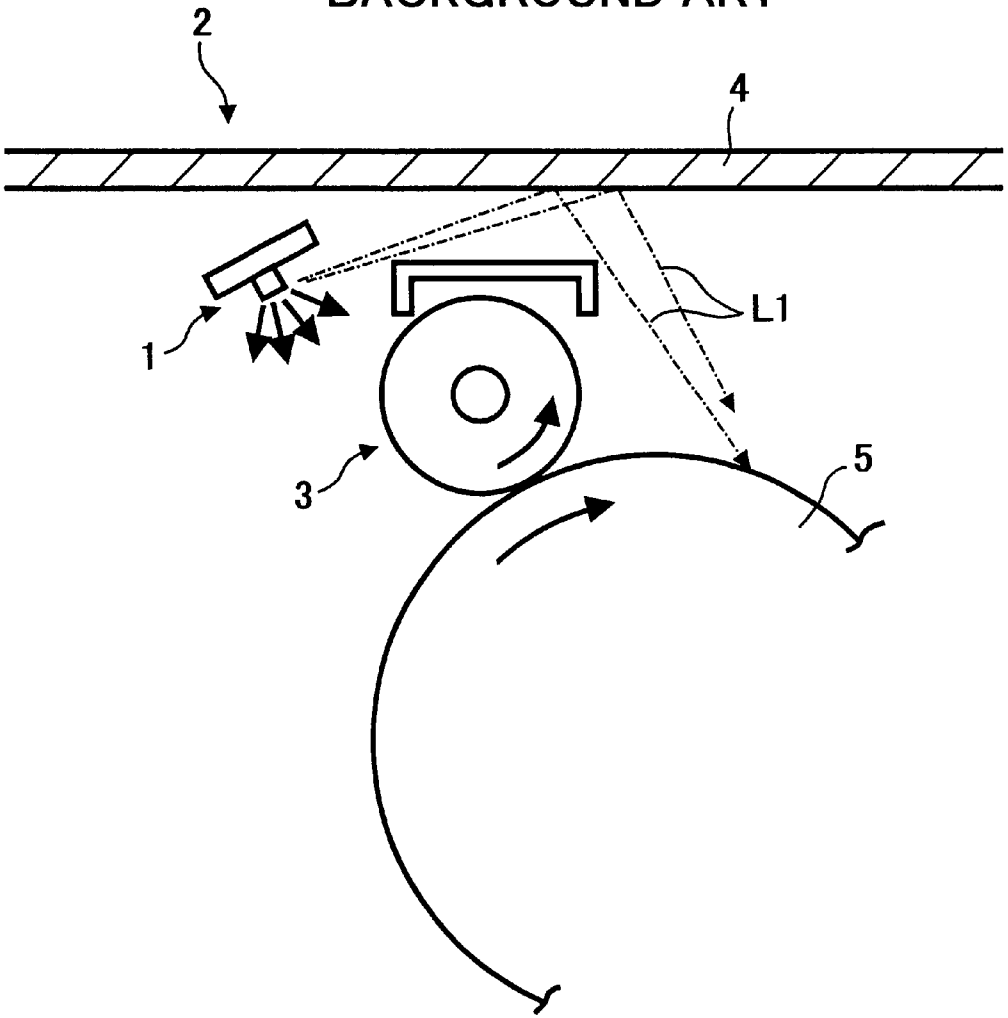
FIG. 6 BACKGROUND ART
FIG. 6 is a schematic view of a conventional image forming apparatus, wherein light emitted from a discharging device passes through a back side of a charging device.
Figure 7:
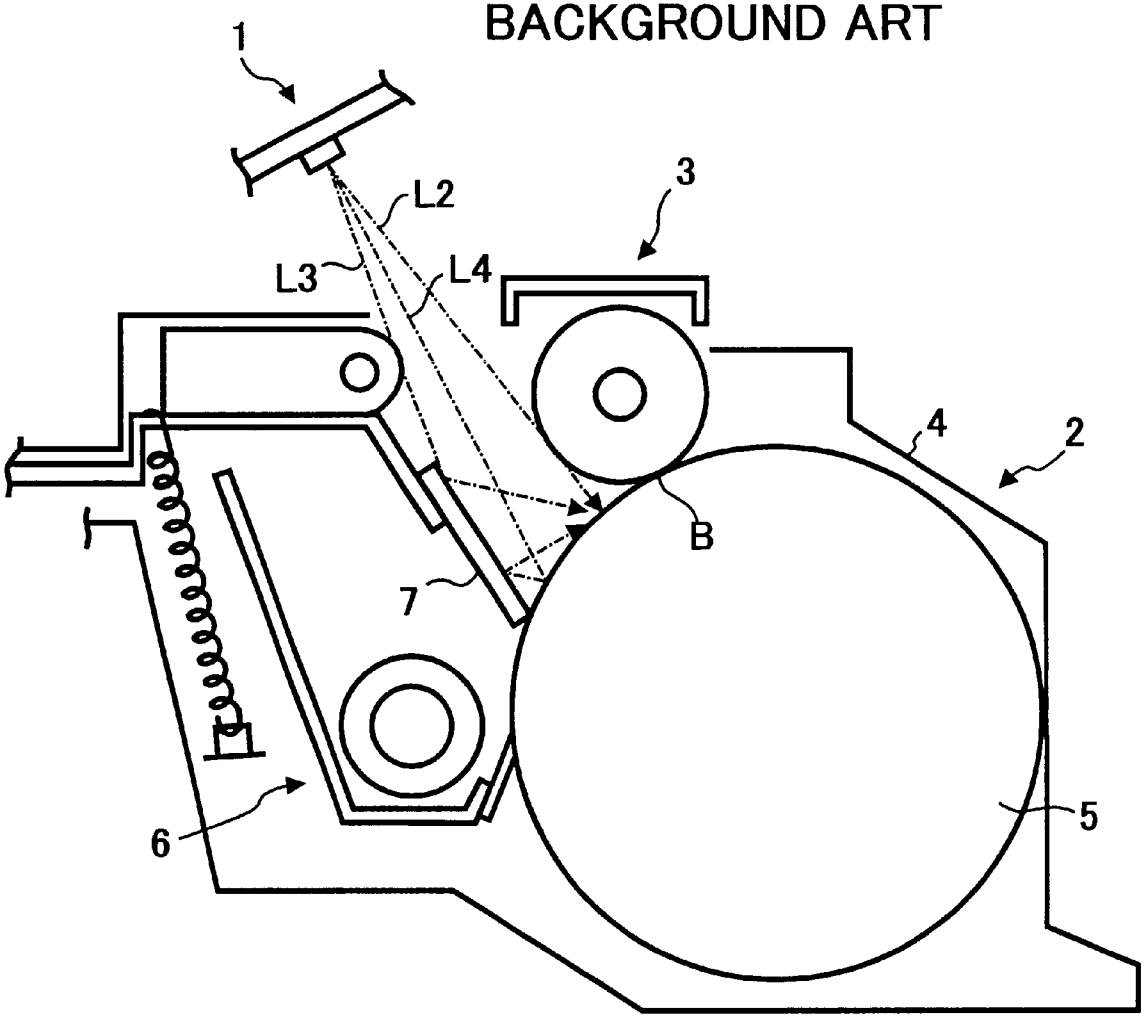
FIG. 7 BACKGROUND ART
FIG. 7 is a schematic view of a conventional image forming apparatus, wherein a surface of a photo-receptor immediately before a charging position is irradiated with light emitted from a discharging device.

In the electrophotographic image forming apparatus of FIG. 5, the surfaces of the cleaning blade 23 and the cleaning blade holder 22 of the cleaning device 24 are subject to mat treatment. Because of the mat treatment, light, indicated by a reference character L8, which is emitted from the discharging device 25 and reflected by the surfaces of the cleaning blade 23 and the cleaning blade holder 22, scatters. As a result, the amount of light L8, which irradiates the area of the surface of the photo-receptor 10, within 5 mm from the charging position A, at an upstream side of the charging position A, can be reduced.

Alternatively, when the surfaces of the cleaning blade 23 and the cleaning blade holder 22 of the cleaning device 24 are blackened, the light L8, which is emitted from the discharging device 25 and which irradiates the surfaces of the cleaning blade 23 and the cleaning blade holder 22, is typically absorbed. As a result, the amount of light L8, which irradiates the area of the surface of the photo-receptor 10, within 5 mm from the charging position A, at an upstream side of the charging position A, can be reduced.

In the process cartridge 40 illustrated in FIGS. 2 through 5, a bracket 44 is supported by the cartridge case 41 such that the bracket 44 can rotate around a support shaft 43. The cleaning blade holder 22 is provided with the bracket 44. The tip portion of the cleaning blade 23 is in press-contact with the surface of the photo-receptor 10 by the biasing force of a spring 45 against the bracket 44. The cleaning blade holder 22 is rotated by pushing the bracket 44 against the biasing force of the spring 45.

With the above-described configurations of the electrophotographic image forming apparatus of the present invention, lowering of a charged potential of a surface of a photoreceptor, which is caused by irradiating the surface of the photo-receptor immediately before a charging position with a light emitted from a discharging device, can be prevented. As a result, deterioration of image quality, due to the lowering of the charged potential of the surface of the photo-receptor, can be avoided.

Further, in the above-described electrophotographic image forming apparatus of the present invention, a discharging device is provided outside of a process cartridge. Because of this configuration, there is no fear of change of a charged potential of a surface of a photo-receptor caused by irradiation of the surface of the photo-receptor with a light emitted from a discharging device and reflected by an inner surface of a cartridge case of a process cartridge.

Furthermore, because the discharging device is provided outside of the process cartridge in the above-described electrophotographic image forming apparatus of the present invention, the discharging device is not likely to be stained by toner scattered in the process cartridge. Therefore, it is not necessary to increase an amount of light emitted from the discharging device beforehand, in consideration of the adhering of toner to the discharging device.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An electrophotographic image forming apparatus, comprising:

a process cartridge including a photo-receptor and a charging device, wherein a toner image is formed on said photo-receptor, and said charging device is configured to uniformly charge a surface of said photo-receptor; and a discharging device provided outside of said process cartridge and configured to emit light to discharge a surface of said photo-receptor, wherein said process cartridge also includes a light incidence opening to pass the light emitted from said discharging device therethrough, wherein said light incidence opening is formed to regulate the light passed so as to irradiate an area of said surface of said photo-receptor and, wherein a first area, of said surface of said photo-receptor which has been irradiated, is outside of a second area of said surface of said photo-receptor, said second area being within 5 mm from a position where said charging device charges said surface of said photo-receptor at an upstream side of said position.

2. The electrophotographic image forming apparatus according to claim 1, wherein said process cartridge further includes a cleaning device, configured to remove residual toner remaining on said surface of said photo-receptor, after said toner image, formed on said photo-receptor, is transferred to a recording medium, and wherein all of said photo-receptor, said discharging device, said light incidence opening, and said cleaning device are arranged such that the light from said discharging device, reflected by said cleaning device, does not lead to said second area of said surface of said photo-receptor which is within 5 mm from said position where said charging device charges said surface of said photo-receptor at said upstream side of said position.

3. The electrophotographic image forming apparatus according to claim 1, wherein said process cartridge further includes a cleaning device, configured to remove residual toner remaining on said surface of said photo-receptor, after said toner image, formed on said photo-receptor, is transferred to a recording medium, and wherein all of said photo-receptor, said discharging device, said light incidence opening, and said cleaning device are arranged such that the light from said discharging device, first reflected by said photo-receptor and then, reflected by said cleaning device, does not lead to said second area of said surface of said photo-receptor within 5 mm from said position where said charging device charges said surface of said photo-receptor at said upstream side of said position.

4. The electrophotographic image forming apparatus according to claim 1, wherein said process cartridge further includes a cleaning device, configured to remove residual toner remaining on said surface of said photo-receptor, after said toner image, formed on said photo-receptor, is transferred to a recording medium, and wherein a surface of each part of said cleaning device, which has been irradiated with the light from said discharging device, is subject to mat treatment.

5. The electrophotographic image forming apparatus according to claim 1, wherein said process cartridge further includes a cleaning device, configured to remove residual toner remaining on said surface of said photo-receptor, after said toner image, formed on said photo-receptor, is transferred to a recording medium, and wherein a surface of each part of said cleaning device, which has been irradiated with the light from said discharging device, is blackened.

6. An electrophotographic image forming apparatus, comprising:

means for accommodating both means for forming a toner image thereon and means for uniformly charging a surface of said toner image forming means; and means for emitting light to discharge said surface of said toner image forming means, said light emitting means being provided outside of said accommodating means, wherein said accommodating means includes means for both passing the light emitted from said light emitting means therethrough and regulating the light passed so as to irradiate an area of said surface of said toner image forming means and, wherein said area, of said surface of said toner image forming means which has been irradiated, is outside of an area of said surface of said toner image forming means which is within 5 mm from a position where said charging means charges said surface of said toner image forming means at an upstream side of said position.

7. The electrophotographic image forming apparatus according to claim 6, wherein said accommodating means further includes means for removing residual toner remaining on said surface of said toner image forming means, after said toner image, formed on said toner image forming means, is transferred to means for recording, and wherein all of said toner image forming means, said light emitting means, said light passing and regulating means, and said residual toner removing means are arranged such that the light from said light emitting means, reflected by said residual toner removing means, does not lead to said area of said surface of said toner image forming means within 5 mm from said position where said charging means charges said surface of said toner image forming means at said upstream side of said position.

8. The electrophotographic image forming apparatus according to claim 6, wherein said accommodating means further includes means for removing residual toner remaining on said surface of said toner image forming means, after said toner image, formed on said toner image forming means, is transferred to means for recording, and wherein all of said toner image forming means, said light emitting means, said light passing and regulating means, and said residual toner removing means are arranged such that the light from said light emitting means, first reflected by said toner image forming means and then, reflected by said residual toner removing means, does not lead to said area of said surface of said toner image forming means within 5 mm from said position where said charging means charges said surface of said toner image forming means at said upstream side of said position.

9. The electrophotographic image forming apparatus according to claim 6, wherein said accommodating means further includes means for removing residual toner remaining on said surface of said toner image forming means, after said toner image, formed on said toner image forming means, is transferred to means for recording, and wherein a surface of each part of said residual toner removing means, irradiated with the light from said light emitting means, is subject to mat treatment.

10. The electrophotographic image forming apparatus according to claim 6, wherein said accommodating means further includes means for removing residual toner remaining on said surface of said toner image forming means, after said toner image, formed on said toner image forming means, is transferred to means for recording, and wherein a surface of each part of said residual toner removing means, irradiated with the light from said light emitting means, is blackened.

11. A method of forming an image in an electrophotographic image forming apparatus, comprising the steps of:

charging a surface of a photo-receptor with a charging device in a process cartridge;

emitting light from a discharging device arranged outside of said process cartridge to discharge said surface of said photo-receptor; and regulating the light passing through a light incidence opening formed in said process cartridge so as to irradiate an area of said surface of said photo-receptor, wherein said step of regulating includes irradiating said area of said surface of said photo-receptor outside of an area of said surface of said photo-receptor within 5 mm from a position where said charging device charges said surface of said photo-receptor at an upstream side of said position.

12. The method according to claim 11, wherein said step of regulating includes:

causing the light from said discharging device, reflected by a cleaning device provided in said process cartridge, to remove residual toner remaining on said surface of said photo-receptor, not to lead to said area of said surface of said photo-receptor within 5 mm from said position where said charging device charges said surface of said photo-receptor at said upstream side of said position.

13. The method according to claim 11, wherein said step of regulating includes:

causing the light from said discharging device, first reflected by said photo-receptor and then, reflected by a cleaning device provided in said process cartridge, to remove residual toner remaining on said surface of said photo-receptor, not to lead to said area of said surface of said photo-receptor within 5 mm from said position where said charging device charges said surface of said photo-receptor at said upstream side of said position.

* * * * *